US006138577A

United States Patent [19]

Dalrymple

[11] Patent Number: 6,138,577

[45] Date of Patent: Oct. 31, 2000

[54] CENTER PLATE FOR RAILCARS

[75] Inventor: Thomas H. Dalrymple, Duncanville, Tex.

[73] Assignee: TRN Business Trust, Dallas, Tex.

[21] Appl. No.: 09/136,899

[22] Filed: Aug. 19, 1998

Related U.S. Application Data

[60] Provisional application No. 60/056,121, Aug. 20, 1997.

[51] Int. Cl.[7] ..... B61F 5/00

[52] U.S. Cl. ..... 105/199.4

[58] Field of Search ..... 105/199.1, 199.4

[56] References Cited

U.S. PATENT DOCUMENTS

| | | | |
|---|---|---|---|
| 3,831,530 | 8/1974 | Cope et al. | 105/199 C |
| 4,056,065 | 11/1977 | Fiegl et al. | 105/199 C |
| 4,744,308 | 5/1988 | Long et al. | 105/199.4 |

OTHER PUBLICATIONS

Engineering drawing, dated Jun. 3, 1995, property of Trinity Industries, Inc.

Engineering drawing, dated Jul. 31, 1996, property of American Steel Foundaries.

Quality Products for Freight Cars and Passenger Cars, Transportation Equipment, Dresser Catalog, 1974.

*Primary Examiner*—Mark T. Le

*Attorney, Agent, or Firm*—Baker Botts L.L.P.

[57] ABSTRACT

A center plate (20) is provided for installation in a center plate pocket (21) in the underside of a railcar (10) undercarriage. The center plate (20) comprises an upper wall section (36), a lower cap section (38), and a weld area (32) between the upper wall section (36) and the lower cap section (38). When the center plate (20) is in the center plate pocket (21) the weld area (32) forms a continuous grooved perimeter which allows for the center plate (20) to be welded to the undercarriage with a single weld.

22 Claims, 6 Drawing Sheets

CENTER PLATE FOR RAILCARS

RELATED APPLICATIONS

This application claims the benefit of U.S. Provisional Application No. 60/056,121 filed Aug. 20, 1997.

TECHNICAL FIELD OF THE INVENTION

This invention relates to the field of railcars and, more specifically, to an improved center plate for railcars.

BACKGROUND OF THE INVENTION

In a typical railcar, the entire weight of the railcar is carried on two center plates secured to two body bolsters which engage matching bowls on cooperating truck bolsters. As a result, the center plates are subject to the weight of the car and load as well as the dynamics of a loaded, moving car.

A typical center plate is installed in a square or rectangular opening on the undercarriage. The center plate often has leveling feet located at each corner. The center plate is typically secured to the undercarriage by welding between the leveling feet.

One drawback of current center plates is that because of the location of the leveling feet, four separate welds must be made to secure the center plate to the undercarriage. This design does not lend itself to modern manufacturing methods such as robotic welders which are generally better at making continuous welds rather than intermittent welds.

Another drawback of a conventional center plate is that because of its generally symmetrical configuration, it is possible to install the center plate with the wrong orientation. This leads to added costs when the center plate has to be removed and rewelded. Misalignment is also a potential hazard if the misalignment goes unnoticed and a misaligned center plate is used in an operational railcar.

Finally, conventional center plates fit into the undercarriage in such a way that they cannot be welded to the inside of the undercarriage even if the inside of the undercarriage was readily accessible.

SUMMARY OF THE INVENTION

From the foregoing, it may be appreciated that a need has arisen for an improved center plate for railcars. In accordance with the teachings of the present invention, an improved center plate for railcars is provided which substantially eliminates or reduces disadvantages and problems associated with prior center plates.

In one embodiment of the present invention, a center plate for use in a railcar undercarriage is provided. The center plate comprises an upper wall section insertable into the undercarriage, a lower cap section for connecting to a railway truck assembly and a weld area between the lower cap section and the upper wall section. The weld area forms a continuous groove around the perimeter for welding the center plate to the undercarriage.

In another embodiment, a railcar is provided. The railcar comprises an undercarriage having a pair of draft sills and a center plate pocket formed as part of each draft sill. A center plate comprising an upper wall section and a lower cap section is also provided. The center plate is insertable into the center plate pocket and the lower cap section connects to a railway truck assembly. A weld area, located between the lower cap section and the upper wall section, forms a substantially continuous perimeter for welding the center plate to the undercarriage.

The present invention provides various technical advantages over previous center plates. For example, one technical advantage is that the center plate can be secured with a single continuous weld. Another technical advantage is that the center plate is designed so that it cannot be improperly installed. Yet another advantage is that the center plate can be welded inside the undercarriage, as well as outside the undercarriage. Other technical advantages may be readily apparent to one skilled in the art from the following figures, descriptions and claims.

BRIEF DESCRIPTION OF THE DRAWINGS

For a more complete understanding of the present invention and for further features and advantages, reference is now made to the following descriptions taken in conjunction with the accompanying drawings, in which.

DETAILED DESCRIPTION OF THE INVENTION

The present invention and its advantages are best understood by referring to FIGS. 1–7 of the drawings, like numerals being used for like and corresponding parts of the drawings.

Figure 1:
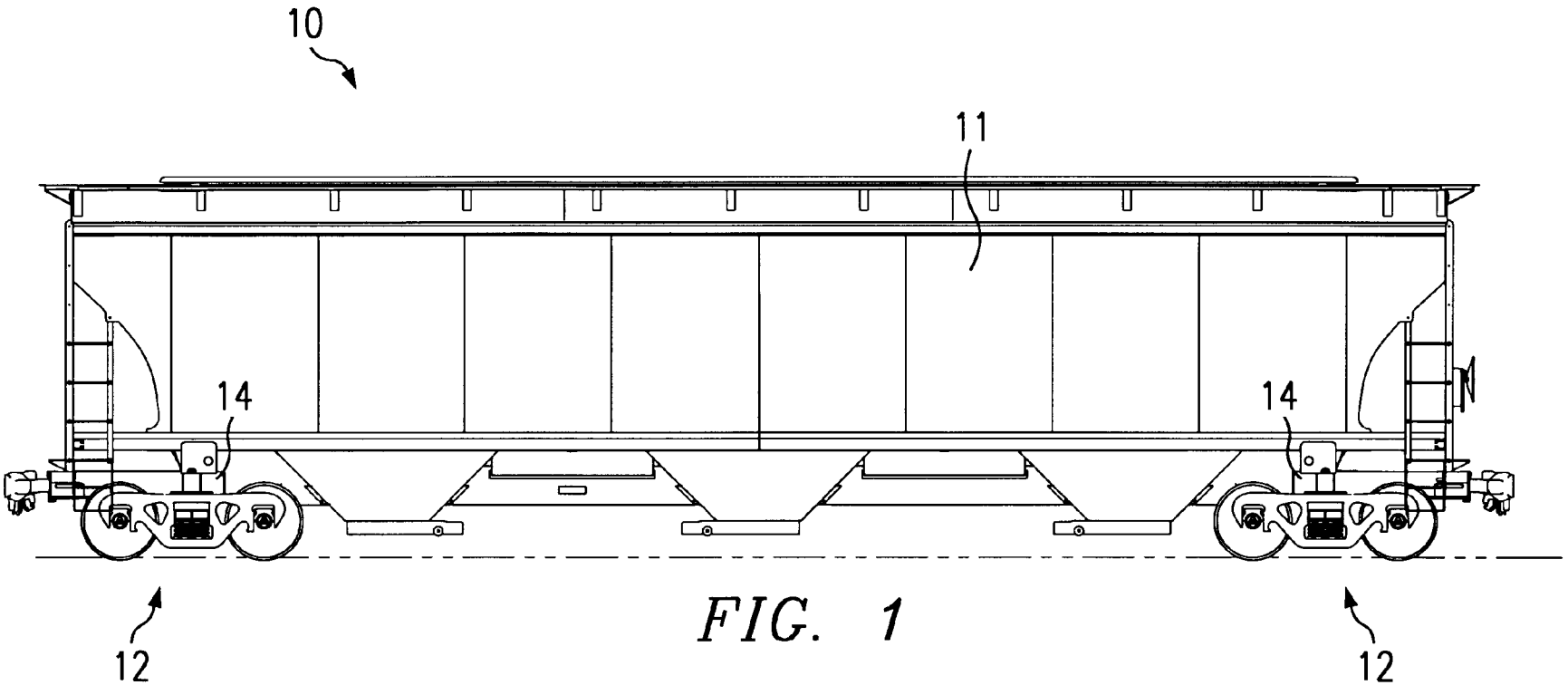
FIG. 1 illustrates a typical railcar incorporating teachings of the present invention.

FIG. 1 illustrates a typical railcar 10. Railcar 10 is illustrated as a hopper car, however, it can be any type of railcar including, but not limited to, a tank car, a flat car, a gondola car, a boxcar, or any other railcar. Railcar 10 comprises a railcar body 11 attached to a pair of railway trucks 12, one pair forward and one pair at the rear. Railway trucks 12 are attached at a draft sill 14 in a manner illustrated in FIG. 2. The term draft sill 14 refers to the portion of the associated railcar undercarriage that attaches to trucks 12. Draft sill 14 may be part of a full underframe arrangement, a stub sill arrangement or any other configuration known in the industry.

Figure 2:
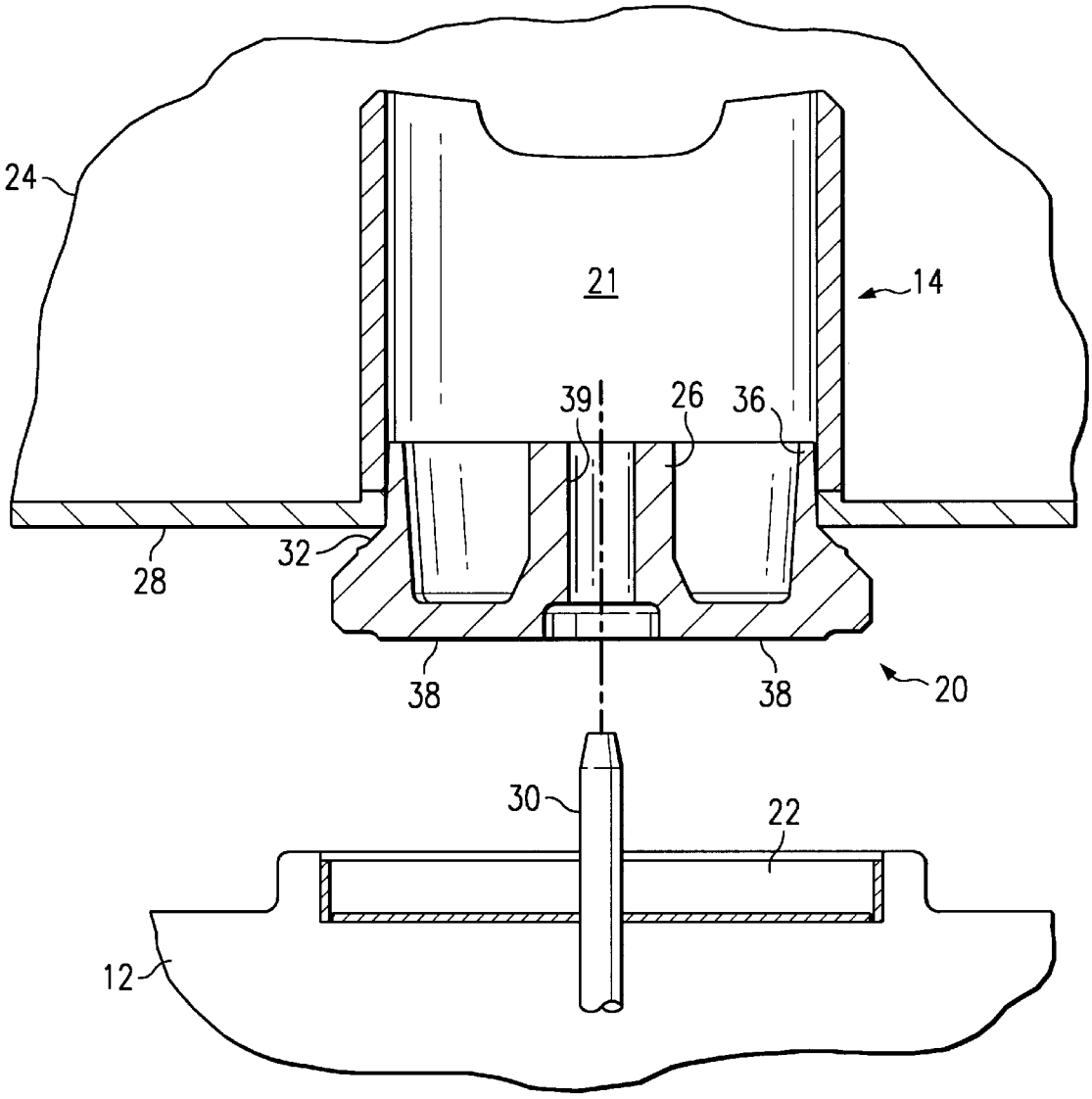
FIG. 2 is a schematic drawing showing an exploded view of a center plate installed in an undercarriage along with a center bowl in accordance with the teachings of the present invention.

FIG. 2 illustrates a center plate 20 installed in an undercarriage 24 along with a center bowl 22. Center plate 20 is inserted into a center plate pocket 21 of undercarriage 24 such that an upper wall 36 is inside center plate pocket 21. Undercarriage 24 consists of draft sill 14 and a body bolster 28. Also illustrated is part of truck 12 containing a center bowl 22. Center bowl 22 is designed to accept center plate 20. Center plate 20 is secured to center bowl 22 (and therefore truck 12) via a center pin 30 which inserts into a bore 39. In this way, low cap section 38 contacts center bowl 22 and the weight of railcar 10 is supported at center plate 20 and ultimately truck 12.

Figure 3A:
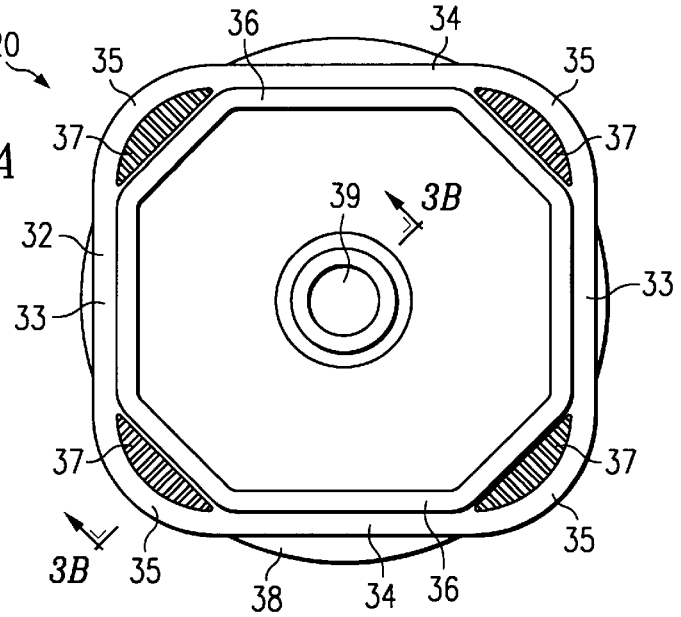
FIG. 3A illustrates a plan view of the center plate.
Figure 8:
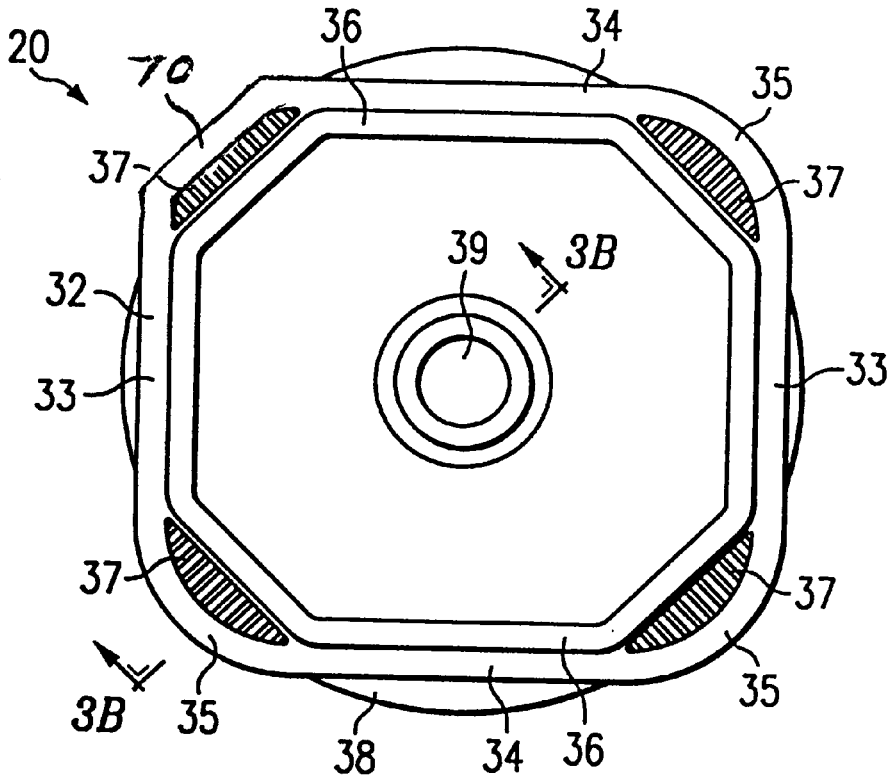
FIG. 8 is a plan view of a center plate in accordance with an alternate embodiment of the present invention.

FIG. 3A illustrates a plan view of center plate 20. Center plate 20 comprises a weld area 32 having two pairs of parallel sides 33 and 34, each side connected by a curved corner 35. Alternatively the straight sections may be coupled by one or more straight sections 70 or a combination of straight and curved sections as shown, for example, in FIG. 8. This forms, in one embodiment, a generally square or rectangular shape with rounded corners. Leveling feet 37 are located inside weld area 32. By placing leveling feet 37 inside weld area 32, weld area 32 defines a generally continuous grooved perimeter to be welded. Adjacent to weld area 32 is upper wall section 36, seen, in this embodiment, as generally octagonal in shape. Upper wall section 36 is inserted into center plate pocket 21 as seen in FIG. 2. In the middle is a bore 39 for receiving center pin 30. At the bottom of weld area 32 is lower cap section 38 of a generally circular shape and typically of a greater diameter than weld area 32. Lower cap section 38 engages the center bowl 22 as shown in FIG. 2.

The design of weld area 32 allows it to be secured to undercarriage 24 by a single weld laid down around the entire perimeter of weld area 32. This is advantageous for two reasons. First, since the termination points of welds tend to concentrate stress, they are more susceptible to fatigue cracks and failure. A traditional center plate has four leveling feet located outside the weld area. This means a weld must start at a one leveling foot and end at another one. Therefore, traditional center plates require eight welding end points versus none for the center plate of the present invention. Additionally, modern manufacturing machineries, such as robotic welders, are better at forming single, continuous welds as opposed to multiple short welds and work more efficiently with the design of the present invention.

Figure 3B:
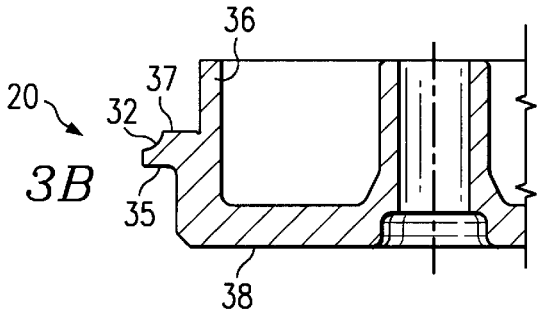
FIG. 3B illustrates a cross-sectional view of the center plate taken along lines 3B—3B of FIG. 3A.

FIG. 3B illustrates a cross section view of center plate 20 taken along the line illustrated in FIG. 3A. Illustrated is upper wall 36, lower cap section 38 and curved section 35. Also visible is leveling foot 37 and weld area 32. As seen in this illustration, weld area 32 is in front of leveling foot 37, thus providing a continuous weld area 32 which can be efficiently welded by automated machinery.

Figure 4:
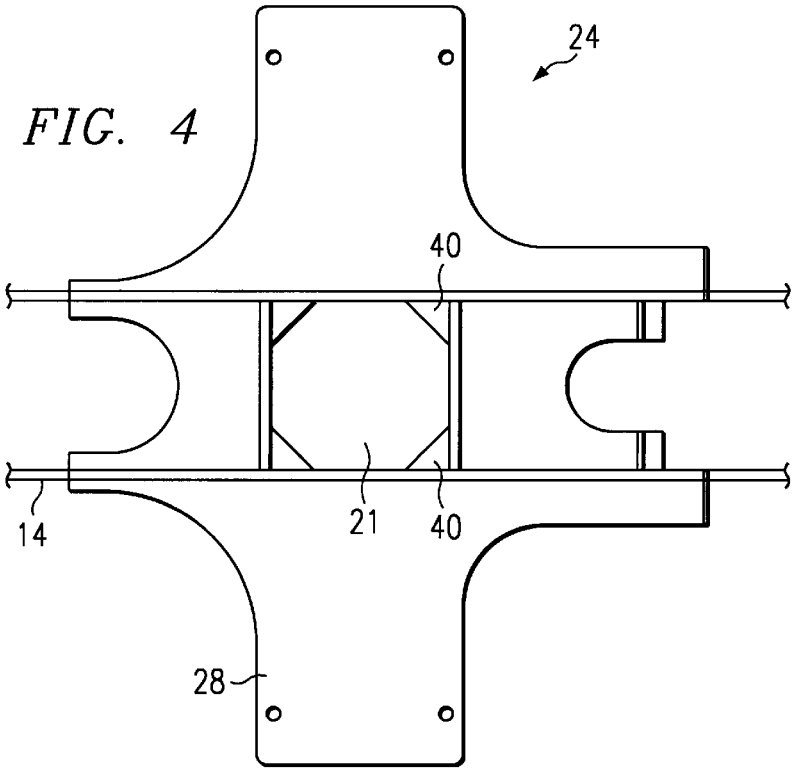
FIG. 4 illustrates a section through the undercarriage of a railcar showing a center plate pocket in accordance with the teachings of the present invention.

FIG. 4 illustrates the undercarriage 24 of railcar 10 showing center plate pocket 21. This cross-sectional view is looking downward towards trucks 12. Illustrated is draft sill 14 and body bolster 28 which comprises undercarriage 24. Center plate pocket 21 is illustrated with an octagonal opening in order to fit octagonal upper wall section 36 and leveling feet contact area 40, for contacting leveling feet. Other shapes for the upper wall section 36 and center plate pocket 21 are possible. Additionally, center plate 20 could have a base designed to fit into the opening of center plate pocket 21 instead of upper wall section 36 extending into the center plate pocket 21.

Figure 5A:
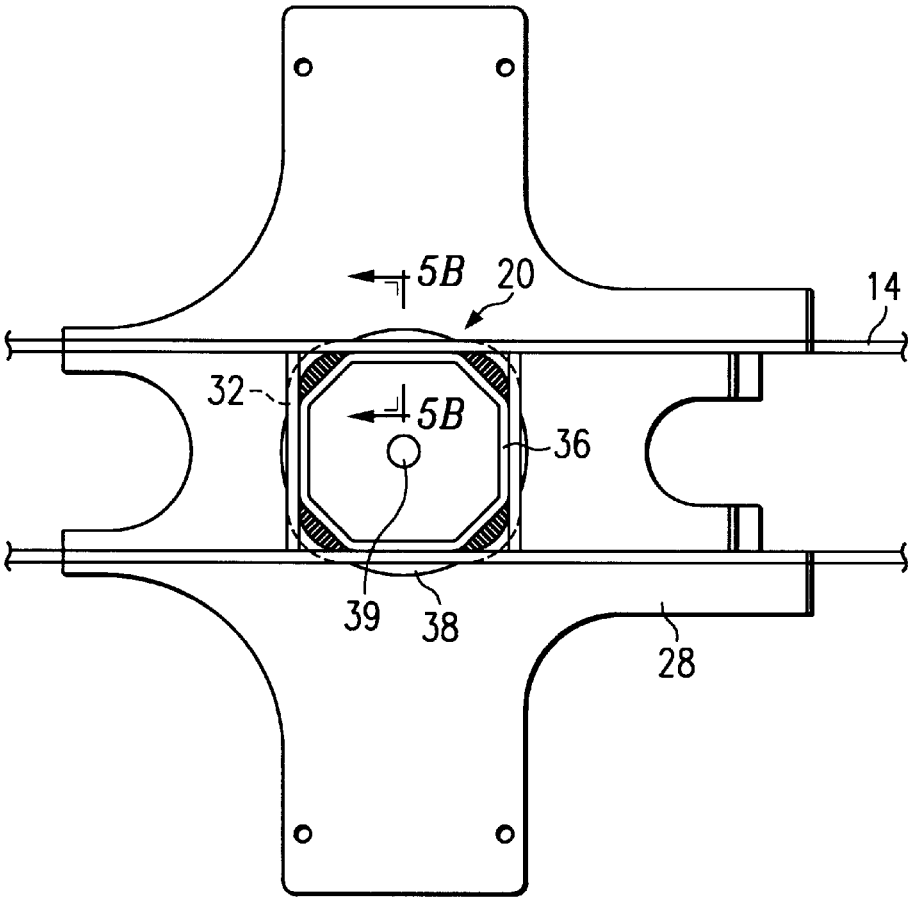
FIG. 5A illustrates center plate installed in center plate pocket.

FIG. 5A illustrates center plate 20 installed in center plate pocket 21. This view is taken along lines 5B—5B and visible are upper wall section 34, weld area 32 and lower cap section 38.

Figure 5B:
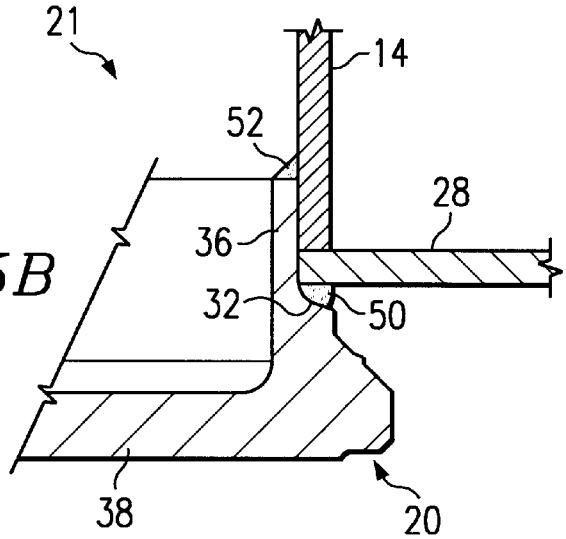
FIG. 5B is a schematic drawing showing a cross-sectional view taken along lines 5B—5B of FIG. 5A in accordance with the teachings of the present invention.

FIG. 5B is a cross-sectional view of FIG. 5A. Illustrated is draft sill 14 and center plate 20. Inserted into center plate pocket 21 is upper wall section 36. Weld area 32 and lower cap section 38 are also shown. An outside weld 50 welds the outside of center plate 20 to the draft sill 14 portion of undercarriage 24. Outside weld 50 is placed around the grooved perimeter of weld area 32 in a long, continuous weld. An inside weld 52 welds upper wall section 36 of center plate pocket 21 to the inside of draft sill 14 in embodiments where there is access to the inside of the center plate pocket 21. In a conventional center plate assembly, the upper wall sections are not horizontal. Typically they are sloped between two or three degrees inward and provide a poor welding surface. Thus, the center plate of the present invention allows center plate 20 to be welded inside and outside draft sill 14.

Figure 6:
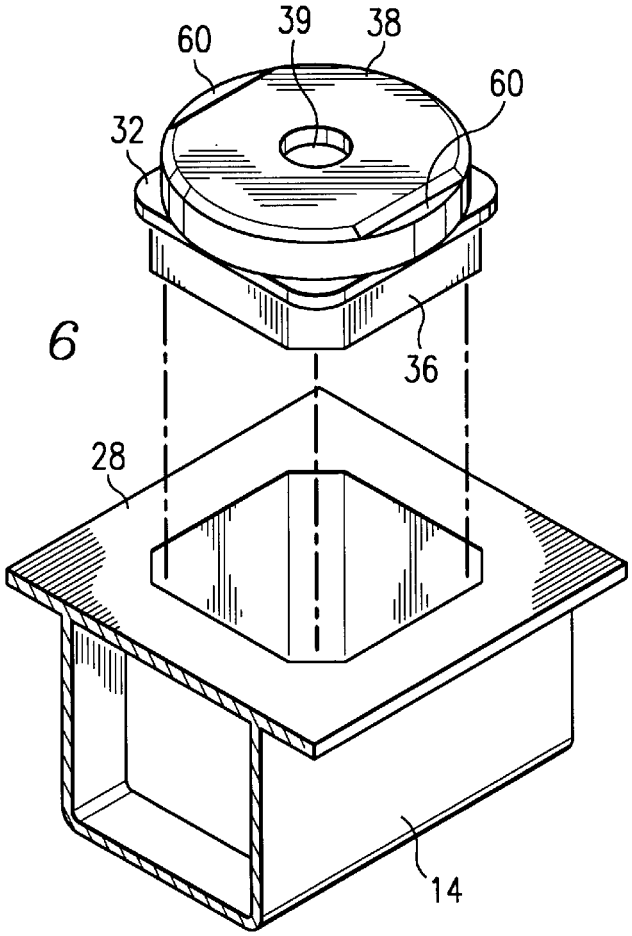
FIG. 6 illustrates an exploded drawing of the lower cap section of the center plate in accordance with the teachings of the present invention; and, FIG. 7 is a schematic drawing showing a plan view of the center plate incorporating teachings of the present invention.

FIG. 6 illustrates the lower cap section 38 of center plate 20. On either side of lower cap section 38 are bevel flats 60. Bevel flats 60 provide line contact instead of point contact when lower cap section 38 is installed in center bowl 22. This provides a relief path for weight loads during operation. The alignment of bevel flats 60 is critical in order for proper load relief.

Center plate 20 is inserted into center plate pocket 21, which is formed by draft sill 14 and body bolster 28.

Figure 7:
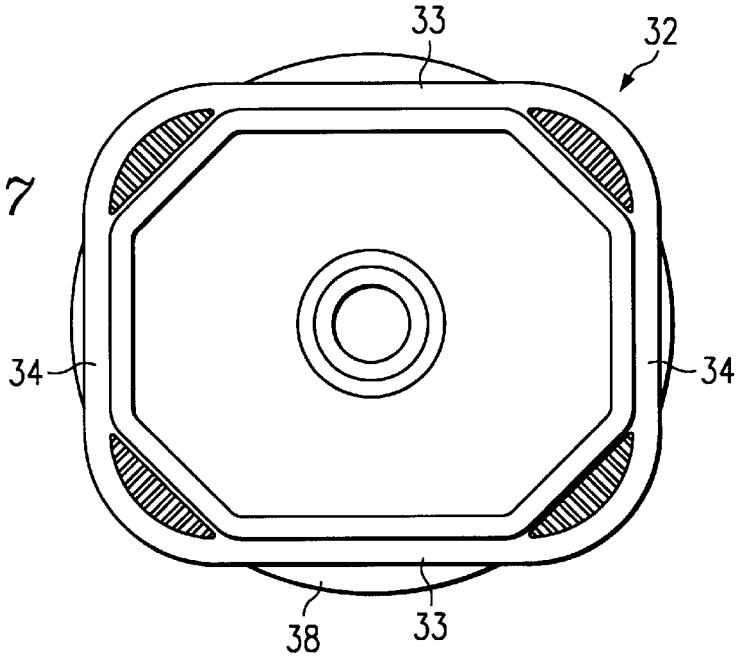

FIG. 7 illustrates another embodiment of the present invention. In this embodiment one of the pairs of sides 33 or 34, is made larger than the other. In a typical, essentially square center plate, all sides are of equal length and the center plate can be installed in one of four positions, two of which are incorrect because bevel flats 60 would be in an improper alignment. If center plate 20 is installed incorrectly, it is expensive to remove and reweld center plate 20. If such a mistake goes unnoticed, potential catastrophic failures could result. By lengthening one pair of sides, either 33 or 34, center plate 20 can fit into center plate pocket 21 in only one of two positions, both of which would align bevel flats 60 correctly. Alternatively, instead of having all rounded corners, weld area 32 could have a sharp corner, which would also ensure proper installation.

Thus, it is apparent that there has been provided, in accordance with the present invention, an improved center plate that satisfies the advantages set forth above. Although several embodiments have been described in detail, it should be understood that various changes, substitutions, and alterations may be apparent to those skilled in the art and may be made herein without departing from the spirit and scope of the present invention as defined by the appended claims.

What is claimed is:

1. A center plate for use in a railcar undercarriage comprising:

an upper wall section insertable into a center plate pocket in the undercarriage and being connected to a weld joint at the distal end of the upper wall section;

a lower cap section for connecting to a truck assembly; and a weld area between the lower cap section and the upper wall section wherein the weld area forms a substantially continuous grooved perimeter for welding the center plate to the undercarriage.

2. The center plate of claim 1, wherein a plurality of leveling feet are provided inside the weld area.

3. The center plate of claim 1, wherein the weld area has two pairs of parallel sides, each side connected by a curved section.

4. A center plate for use in a railcar undercarriage comprising:

an upper wall section insertable into a center plate pocket in the undercarriage;

a lower cap section for connecting to a truck assembly; and a weld area between the lower can section and the upper wall section wherein the weld area forms a substantially continuous grooved perimeter for welding the center plate to the undercarriage, wherein the center plate is generally rectangular in shape and the rectangular shape has two pairs of parallel sides, one pair of parallel sides longer than the other.

5. A center plate for use in a railcar undercarriage comprising:

an upper wall section insertable into a center plate pocket in the undercarriage;

a lower cap section for connecting to a truck assembly; and a weld area between the lower cap section and the upper wall section wherein the weld area forms a substantially continuous grooved perimeter for welding the center plate to the undercarriage, wherein the upper wall section and the center plate pocket are flush with each other to form a second weld area at a distal end of the upper wall section.

6. A center plate for use in a railcar undercarriage comprising:

an upper wall section insertable into a center plate pocket in the undercarriage;

a lower cap section for connecting to a truck assembly; and a weld area between the lower cap section and the upper wall section wherein the weld area forms a substantially continuous grooved perimeter for welding the center plate to the undercarriage, wherein the weld area has two pairs of parallel sides connected by three curved sections and one straight section.

7. A center plate for use in a railcar undercarriage comprising:

base fitting into a center plate pocket in the undercarriage;

a lower cap section for connecting to a truck assembly; and a weld arca between the lower cap section and the base, wherein the weld area has two pairs of parallel sides, one pair of parallel sides longer than the other, each side connected by a curved section.

8. The center plate of claim 7, wherein a second weld area is formed between the base and the center plate pocket.

9. The center plate of claim 7, wherein a plurality of leveling feet are formed inside the weld area.

10. The center plate of claim 7, wherein the weld a area forms a continuous grooved perimeter for welding the center plate to the undercarriage.

11. A center plate for use in a railcar undercarriage comprising:

a base fitting into a center plate pocket in the undercarriage;

a lower cap section for connecting to a truck assembly;

a first weld area formed between the lower cap section and the base; and a second weld area formed between the base and the center plate pocket, the base and center plate pocket being flush with each other to form the second weld area at an end of the base.

12. The center plate of claim 11, wherein a plurality of leveling fee are formed inside the weld area.

13. The center plate of claim 11, wherein the weld area forms a continuous grooved perimeter for welding the center plate to the undercarriage.

14. A center plate for use in a railcar undercarriage comprising:

a base fitting into a center plate pocket in the undercarriage;

a lower cap section for connecting to a truck assembly;

a first weld area formed between the lower cap section and the base; and a second weld area formed between the base and the center plate pocket, wherein the first weld area comprises two pairs of parallel sides, one pair of parallel sides longer than the other, each side connected by a curved section.

15. A railcar comprising:

an undercarriage having a pair of draft sills attached to and supported by a respective railway truck;

a center plate pocket formed as part of each draft sill; and a center plate insertable into the center plate pocket, the center plate having:

an upper wall section being connected to a weld joint at the distal end of the upper wall section;

a lower cap section for connecting to a truck assembly; and a weld area between the lower cap section and the upper wall section wherein the weld area forms a continuous perimeter for welding the center plate to the undercarriage.

16. The railcar of claim 15, wherein the center plate includes a plurality of leveling feet inside of the weld area.

17. The railcar of claim 15, wherein the weld area has two pairs of parallel sides, each side connected by a curved section.

18. A railcar comprising:

an undercarriage having a pair of draft sills attached to and supported by a respective railway truck;

a center plate pocket formed as part of each draft sill; and a center plate insertable into the center plate pocket, the center plate having:

an upper wall section;

a lower cap section for connecting to a truck assembly; and a weld area between the lower cap section and the upper wall section wherein the weld area forms a continuous perimeter for welding the center plate to the undercarriage, wherein the center plate is generally rectangular in shape and the rectangular shape has two pairs of parallel sides, one pair of parallel sides longer than the other.

19. A railcar comprising:

an undercarriage having a pair of draft sills attached to and supported by a respective railway truck;

center plate pocket formed as part of each draft sill; and a center plate insertable into the center plate pocket, the center plate having:

an upper wall section;

a lower cap section for connecting to a truck assembly; and a weld area between the lower cap section and the upper wall section wherein the weld area forms a continuous perimeter for welding the center plate to the undercarriage, wherein the upper wall section and the center plate pocket are flush with each other to form a second weld area at a distal end of the upper wall section.

20. A railcar comprising:

an undercarriage having a pair of draft sills attached to and supported by a respective railway truck;

a center plate pocket formed as part of each draft sill; and a center plate insertable into the center plate pocket, the center plate having:

an upper wall section;

lower cap section for connecting to a truck assembly; and a weld area between the lower cap section and the upper wall section wherein the weld area forms a continuous perimeter for welding the center plate to the undercarriage, wherein the weld area has two pairs of parallel sides connected by three curved sections and one straight section.

21. A center plate for use in a railcar undercarriage comprising:

an upper wall section insertable into a center plate pocket in the undercarriage;

a lower cap section for connecting to a truck assembly; and a weld area between the lower cap section and the upper wall section wherein the weld area forms a substantially continuous grooved perimeter for welding the center plate to the undercarriage, wherein the center plate is generally rectangular in shape at the weld area and having four straight side sections connected by four curved corner sections, each of the curved corner sections being tangential with two of the straight side sections.

22. A railcar comprising:

an undercarriage having a pair of draft sills attached to and supported by a respective railway truck;

a center plate pocket formed as part of each draft sill; and a center plate insertable into the center plate pocket, the center plate having:

an upper wall section;

a lower cap section for connecting to a truck assembly; and a weld area between the lower cap section and the upper wall section wherein the weld area forms a continuous perimeter for welding the center plate to the undercarriage, wherein the center plate is generally rectangular in shape at the weld area and having four straight side sections connected by four curved corner sections, each of the curved corner sections being tangential with two of the straight side sections.

* * * * *